US010421297B2

(12) United States Patent
Oguchi et al.

(10) Patent No.: US 10,421,297 B2
(45) Date of Patent: Sep. 24, 2019

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/591,317

(22) Filed: May 10, 2017

(65) Prior Publication Data

US 2017/0341427 A1 Nov. 30, 2017

(30) Foreign Application Priority Data

May 24, 2016 (JP) ..... 2016-103096

(51) Int. Cl.
*B41J 2/32* (2006.01)
*B41J 11/04* (2006.01)
*B41J 29/02* (2006.01)

(52) U.S. Cl.
CPC ..... *B41J 11/04* (2013.01); *B41J 2/32* (2013.01); *B41J 29/02* (2013.01)

(58) Field of Classification Search
CPC ..... B41J 2/32; B41J 11/04; B41J 29/02
See application file for complete search history.

(56) References Cited

U.S. PATENT DOCUMENTS

| | | | | |
|---|---|---|---|---|
| 6,744,457 | B2 | 6/2004 | Seino et al. | |
| 2007/0002402 | A1 | 1/2007 | Ochiai et al. | |
| 2008/0180468 | A1 | 7/2008 | Takahashi | |
| 2011/0072989 | A1 | 3/2011 | Ochiai et al. | |
| 2011/0074858 | A1 | 3/2011 | Ochiai et al. | |
| 2012/0038736 | A1 | 2/2012 | Ochiai et al. | |
| 2015/0251459 | A1* | 9/2015 | Murata | B41J 11/70 347/220 |
| 2017/0144455 | A1 | 5/2017 | Ishikawa et al. | |

FOREIGN PATENT DOCUMENTS

| | | |
|---|---|---|
| EP | 1179433 | 2/2002 |
| JP | H02-160558 | 6/1990 |
| JP | 2003-246104 | 9/2003 |
| JP | 2007-045543 | 2/2007 |
| JP | 2008-030302 | 2/2008 |
| WO | 2015/182620 | 12/2015 |

* cited by examiner

*Primary Examiner* — Kristal Feggins
*Assistant Examiner* — Kendrick X Liu
(74) *Attorney, Agent, or Firm* — IPUSA, PLLC

(57) ABSTRACT

A printer includes a printer mechanism unit including a frame and a print head, a platen unit including a platen roller, a detection switch configured to detect connecting of the platen unit to the printer mechanism unit, and a switch holder having the detection switch attached thereto and covering part of the detection switch, wherein the switch holder is mounted to one of the frame and the platen unit.

7 Claims, 22 Drawing Sheets

PRINTER

BACKGROUND OF THE INVENTION

1. Field of the Invention

The disclosures herein relate to a printer.

2. Description of the Related Art

Printers are widely used in cash registers used in stores, ATMs (automatic teller machines) or CDs (cash dispensers) installed in banks, etc.

There is a type of printer that has both a printer mechanism unit provided with a thermal head and a platen unit connected to the printer mechanism unit. Such a printer has a detection switch for detecting the state of connection between the printer mechanism unit and the platen unit.

The detection switch may be disposed in the printer mechanism unit, for example. Connecting the platen unit to a predetermined portion of the printer mechanism unit causes the platen unit to press the detection switch, which causes the connecting of the platen unit to the printer mechanism unit to be detected.

In the case of the detection unit being not correctly installed at a desired position in the printer mechanism unit, the detection unit may fail to correctly detect whether the platen unit is connected to the printer mechanism unit. In some cases, the detection switch may even be destroyed.

There may be a need for a printer that has a detection switch installed at a desired position for detecting whether the printer mechanism unit is connected to the platen unit.

RELATED-ART DOCUMENTS

Patent Document

[Patent Document 1] Japanese Patent No. 2585769
[Patent Document 2] Japanese Patent Application Publication No. 2003-246104

SUMMARY OF THE INVENTION

It is a general object of the present invention to provide a printer that substantially obviates one or more problems caused by the limitations and disadvantages of the related art.

A printer includes a printer mechanism unit including a frame and a print head, a platen unit including a platen roller, a detection switch configured to detect connecting of the platen unit to the printer mechanism unit, and a switch holder having the detection switch attached thereto and covering part of the detection switch, wherein the switch holder is mounted to one of the frame and the platen unit.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments for implementing the invention will be described. The same members or the like are referred to by the same numerals, and a description thereof will be omitted <Printer>

Figure 1:
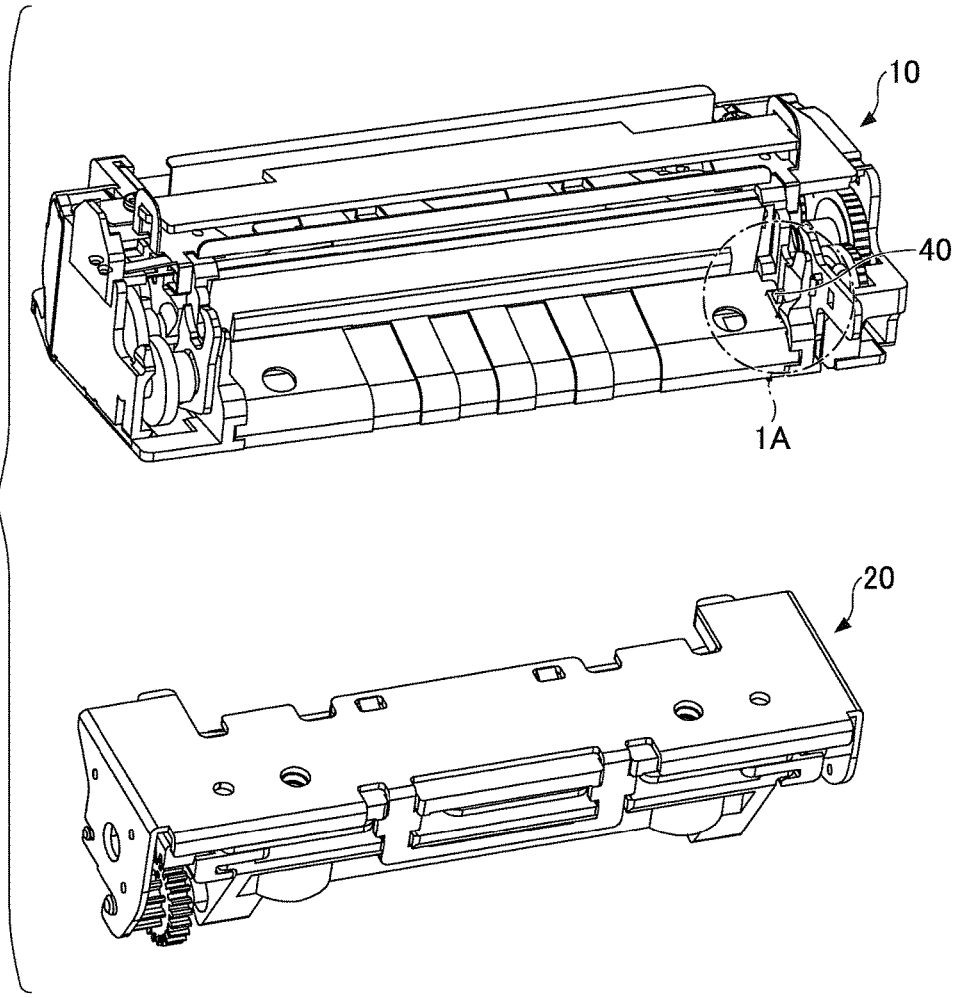
FIG. 1 is an axonometric view of a printer.
Figure 2A:
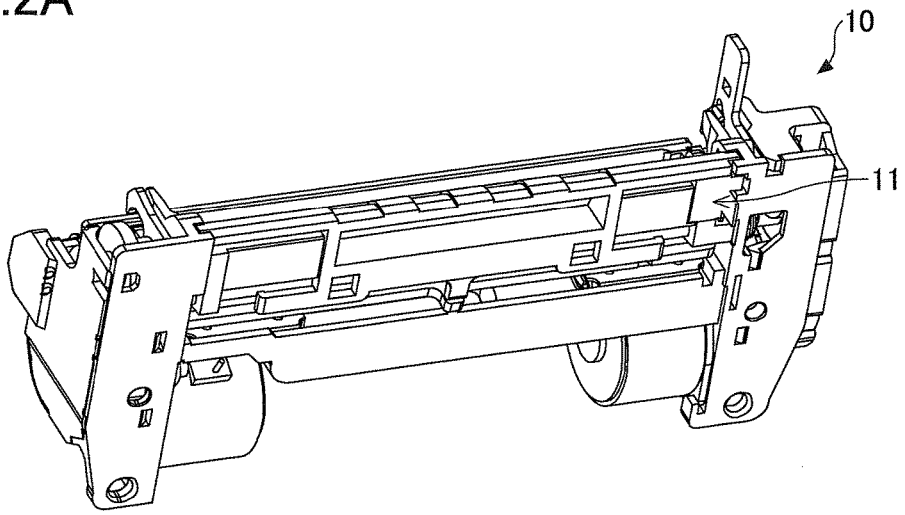
FIGS. 2A and 2B are axonometric views of the printer.
Figure 2B:
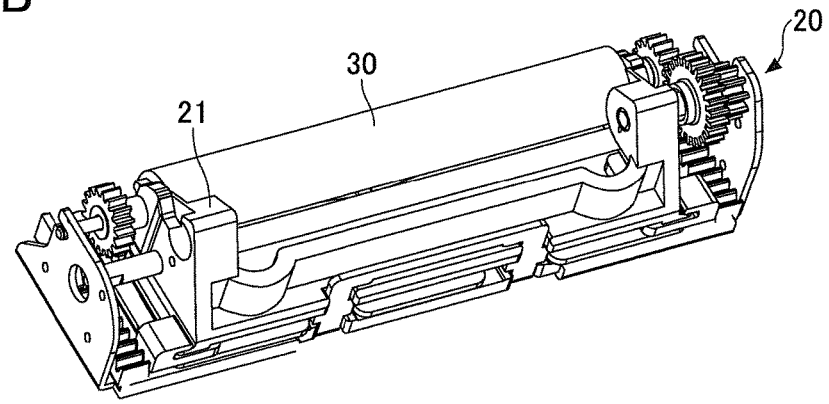
Figure 3A:
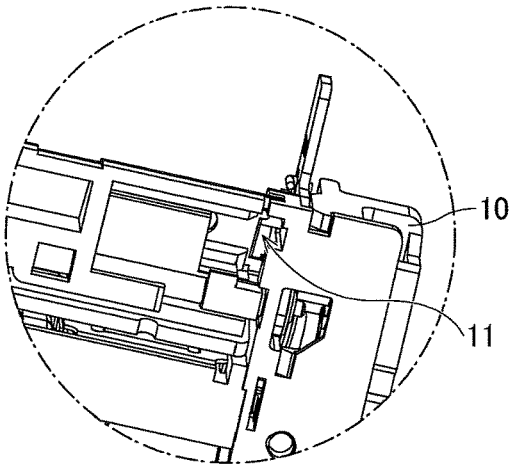
FIGS. 3A through 3C are illustrative drawings showing a method of installing a detection switch.
Figure 3B:
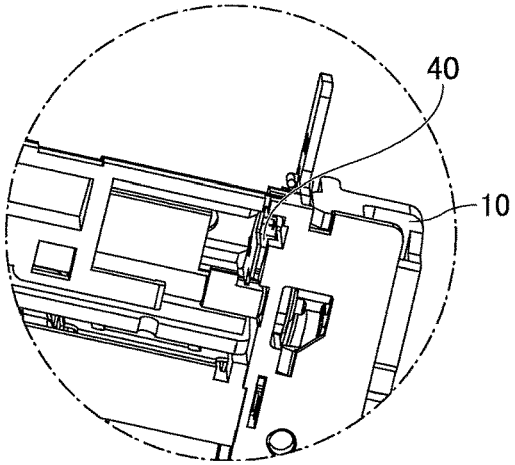
Figure 3C:
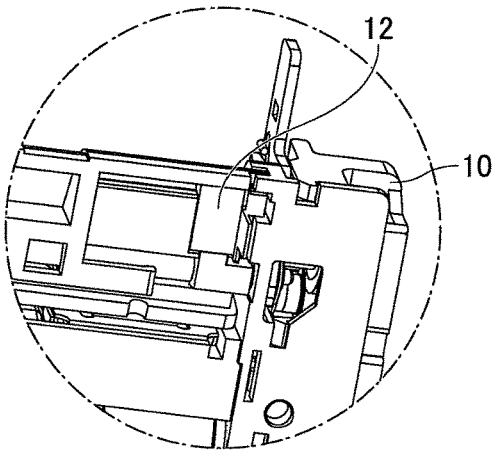
Figure 4A:
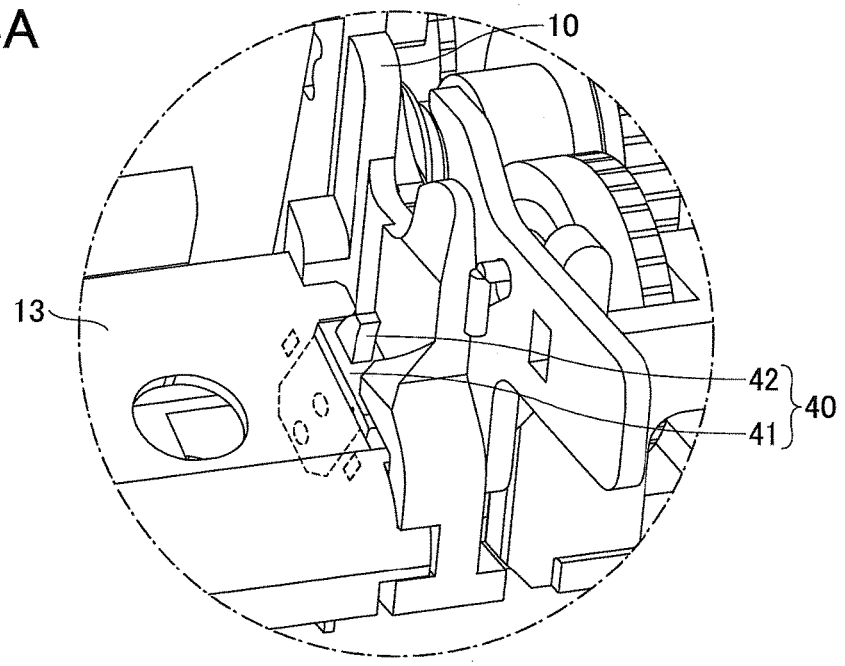
FIGS. 4A and 4B are illustrative drawings showing the detection switch.
Figure 4B:
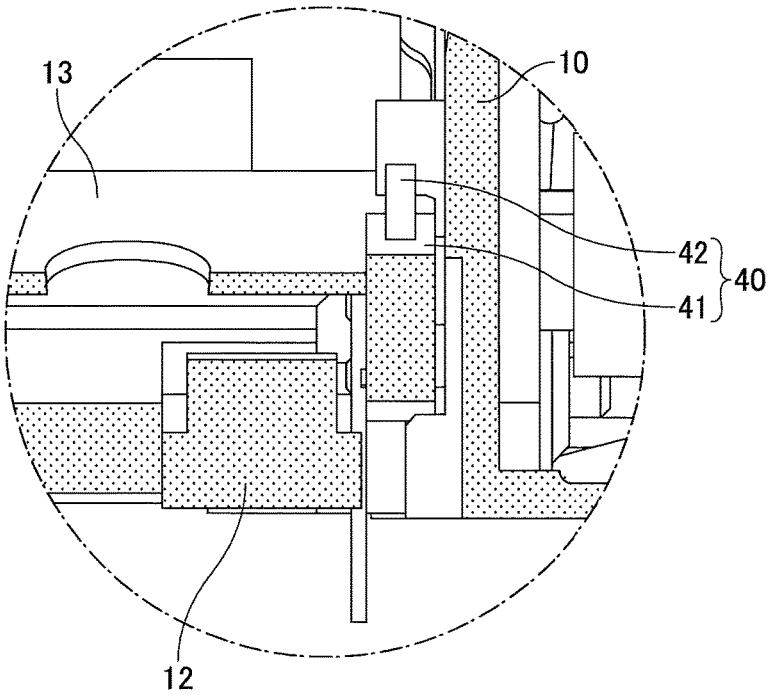
Figure 5A:
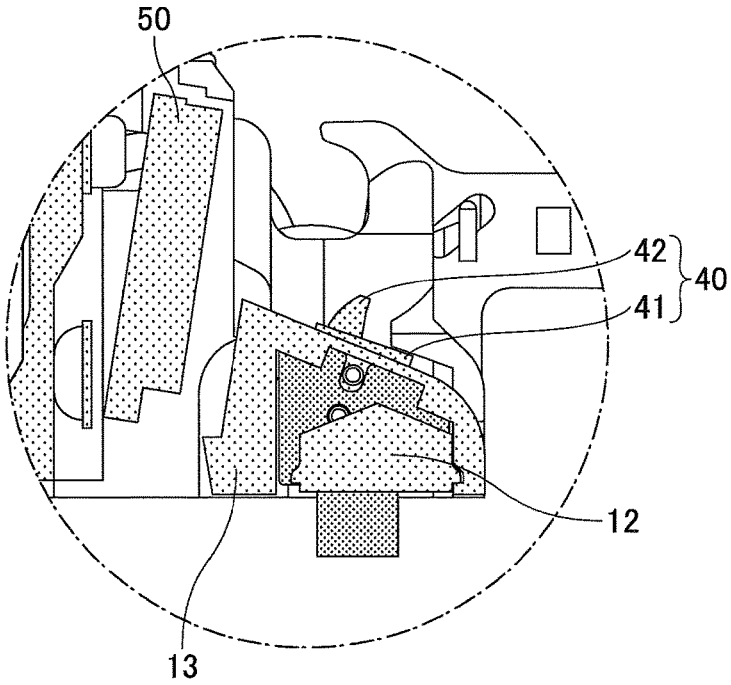
FIGS. 5A and 5B are illustrative drawings showing the detection switch.
Figure 5B:
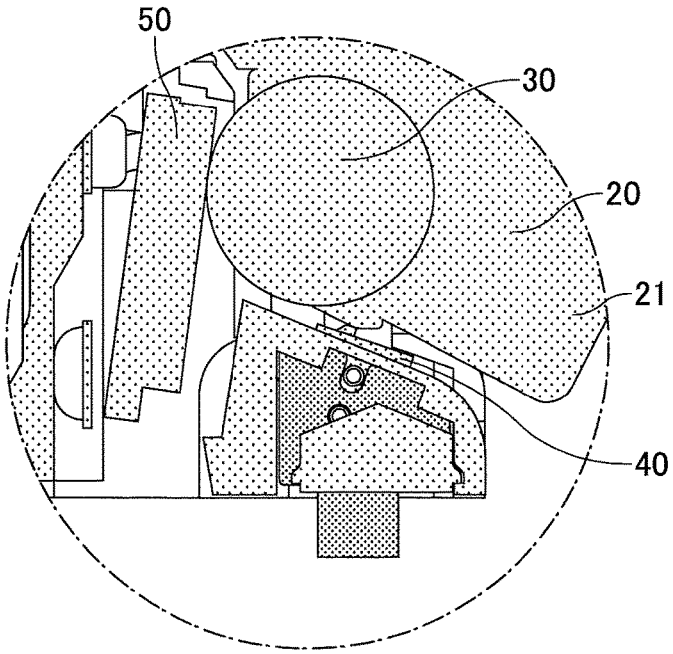

A description will be given of a printer having a printer mechanism unit and a platen unit by referring to FIG. 1 through FIGS. 5A and 5B. As illustrated in FIG. 1 and FIGS. 2A and 2B, the printer includes a printer mechanism unit 10 having a thermal head (not shown) and a platen unit 20 having a platen roller 30. As illustrated in FIGS. 4A and 4B, the printer mechanism unit 10 has a detection switch 40. Connecting the printer mechanism unit 10 to the platen unit 20 as illustrated in FIG. 5 causes a pressing member 21 disposed in the platen unit 20 to press the detection switch 40, which causes the connecting of the printer mechanism unit 10 to the platen unit 20 to be detected. FIG. 1 is an axonometric view of the printer mechanism unit 10 and the platen unit 20. FIG. 2A is an axonometric view of the back side of the printer mechanism unit 10. FIG. 2B is an axonometric view of the platen unit 20 showing the side where the platen roller 30 is to be connected.

The detection switch 40 is attached to the printer mechanism unit 10 through an opening 11 situated in the back face of the printer mechanism unit 10. Specifically, the opening 11 as illustrated in FIG. 3A receives the detection switch 40 inserted thereinto as illustrated in FIG. 3B, and, then, a cover 12 is closed as illustrated in FIG. 3C. This arrangement allows the detection switch 40 to be attached to the printer mechanism unit 10 as illustrated in FIGS. 4A and 4B. FIG. 4A is an axonometric view of a portion enclosed by a dotted and dashed line in FIG. 1. FIG. 4B is a cross-sectional view of the portion where the detection switch 40 is attached. The detection switch 40 is a mechanical switch which includes a switch main unit 41 and an actuator 42. With the detection switch 40 being attached to the printer mechanism unit 10, the actuator 42 projects relative to the surface of a recording-sheet guide 13 in the printer mechanism unit 10.

In the following, a description will be given of detection by the detection switch 40 to detect the connecting of the printer mechanism unit 10 to the platen unit 20 FIG. 5A is a cross-sectional view of the printer mechanism unit 10 before being connected to the platen unit 20. As illustrated in FIG. 5A, the printer mechanism unit 10 has the detection switch 40 and a thermal head 50 installed therein. Connecting the printer mechanism unit 10 to the platen unit 20 causes the pressing member 21 of the platen unit 20 to press the actuator 42 as illustrated in FIG. 5B, thereby turning on the detection switch 40, which means that the connecting of the printer mechanism unit 10 to the platen unit 20 is detected.

The detection switch 40 is directly mounted to the opening 11. The opening 11 is designed to be slightly larger than the detection switch 40, thereby to provide a gap between the detection switch 40 and a chamber for accommodating the detection switch 40. As illustrated in FIG. 5B, connecting the printer mechanism unit 10 to the platen unit 20 causes the pressing member 21 to press the actuator 42 to turn on the detection switch 40.

Because of the presence of a gap between the detection switch 40 and the chamber for accommodating the detection switch 40, the detection switch 40 fastened to the printer mechanism unit 10 may be inadvertently placed in a slanted position. Whether the detection switch 40 is fastened in a slanted position or is fastened in a correct position brings about a difference in the time at which the detection switch 40 is turned on. The detection switch 40 may be turned on before the printer mechanism unit 10 is connected to the platen unit 20, which erroneously indicates that the printer mechanism unit 10 has already been connected to the platen unit 20. In such a case, the platen roller 30 is not secured in a desired position, thereby failing to print on a recording sheet.

Further, pressing the platen unit 20 with an excessive force may create a risk of breaking the detection switch 40. Especially when the detection switch 40 is placed in a slanted position, the platen unit 20 may be further pressed until it is fully engaged with the printer mechanism unit 10 even after the detection switch 40 is turned on. This increases the possibility of the detection switch 40 being broken.

Figure 6A:
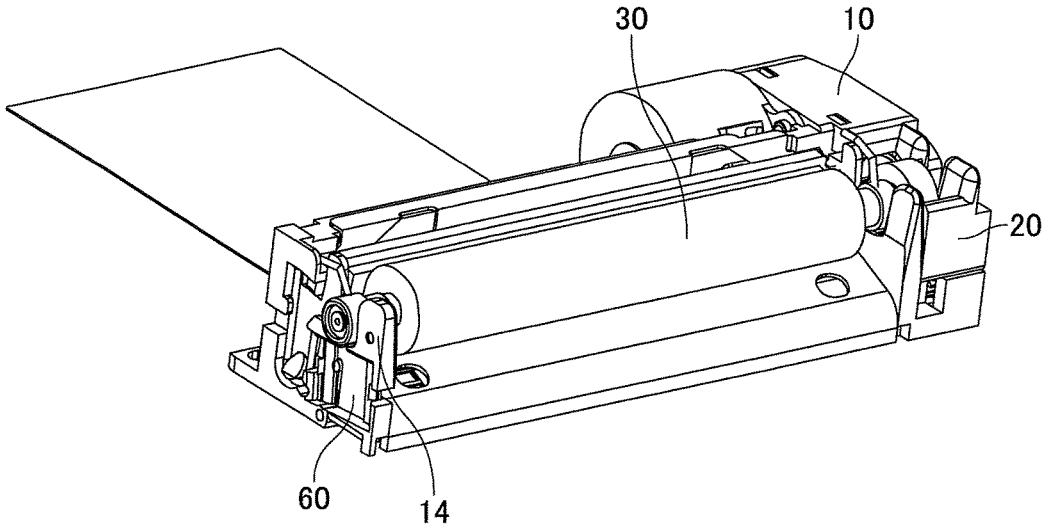
FIGS. 6A and 6B are drawings illustrating a printer of another type.
Figure 6B:
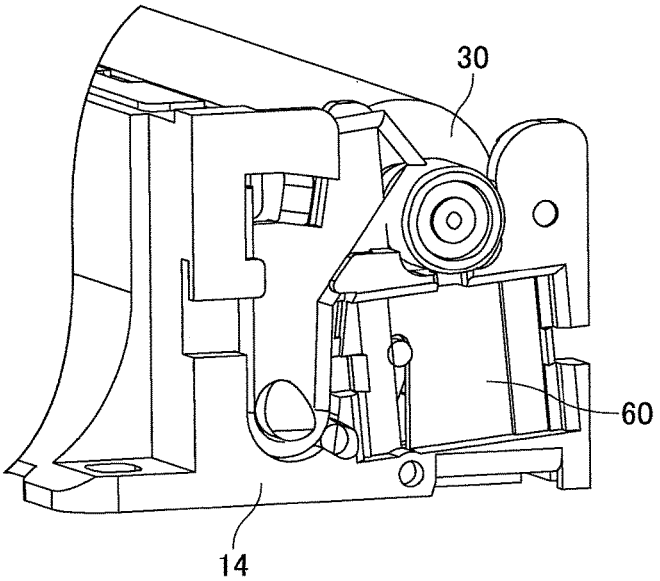

As illustrated in FIGS. 6A and 6B, there is a type of printer that has a detection switch 60 attached to a frame side face 14 of the printer mechanism unit 10. FIG. 6A is an axonometric view of such a printer. FIG. 6B is an axonometric view of the left side face of the printer illustrated in FIG. 6A.

Figure 7A:
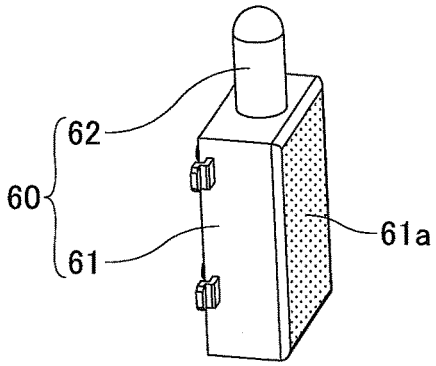
FIGS. 7A and 7B are illustrative drawings showing a detection switch of the printer of FIGS. 6A and 6B.
Figure 7B:
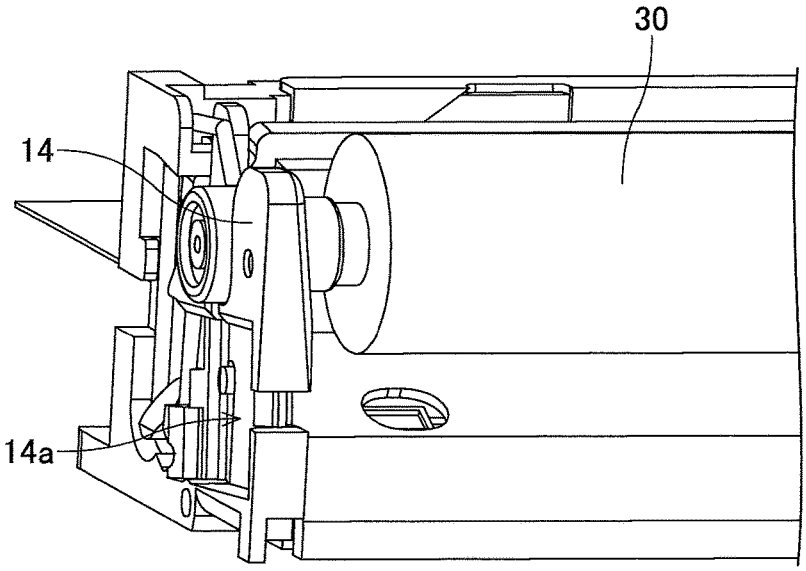

The detection switch 60 used in this printer is a mechanical switch similar to the detection switch 40, and includes a switch main unit and an actuator 62 as illustrated in FIG. 7A. Connecting the platen unit 20 to the printer mechanism unit 10 causes the platen unit 20 to press the actuator 62 to turn on the detection switch 60. As illustrated in FIG. 7B, the frame side face 14 has an opening 14*a* for receiving the detection switch 60. The detection switch 60 is inserted into the opening 14*a* so as to be mounted in the printer mechanism unit 10 as illustrated in FIGS. 6A and 6B. The switch main unit 61 of the detection switch 60 has an outer case 61*a* that is made of metal. In the case of the frame side face 14 being also made of metal, an internal terminal of the detection switch 60 may have an electrical coupling to the frame side face 14 through the outer case 61*a*, thereby causing a failure of the detection switch 60. In order to avoid this, the portion of the outer case 61*a* coming in contact with the frame side face 14 may be covered with a tape made of an insulating material, or an insulating member may be inserted between the outer case 61*a* and the frame side face 14. However, such a configuration increases the number of components and the number of assembly steps, resulting in a cost increase, and is thus not preferable.

<Printer>

In the following, a printer of a present embodiment will be described by referring to FIG. 8. The printer of the present embodiment includes a printer mechanism unit 110 and a platen unit 120. The platen unit 120 has the platen roller 30 attached thereto. Although not illustrated in FIG. 8, the printer mechanism unit 110 includes a thermal head.

Figure 8:
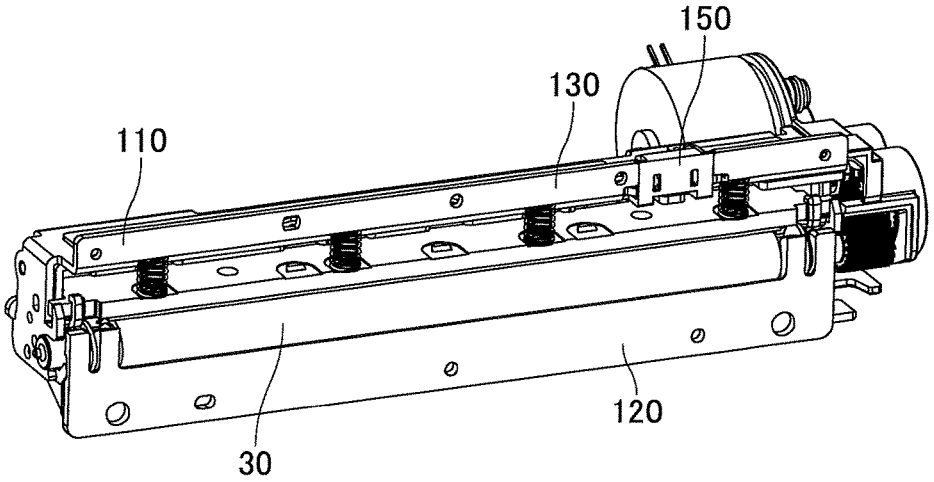
FIG. 8 is an axonometric view of a printer according to an embodiment.
Figure 9A:
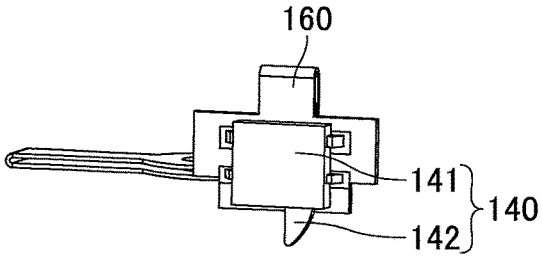
FIGS. 9A and 9B are axonometric views illustrating the detection switch and a switch holder, respectively.
Figure 9B:
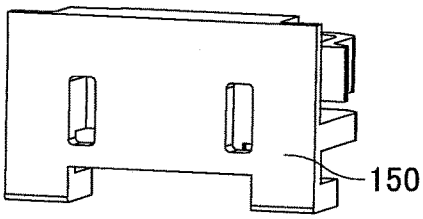
Figure 10A:
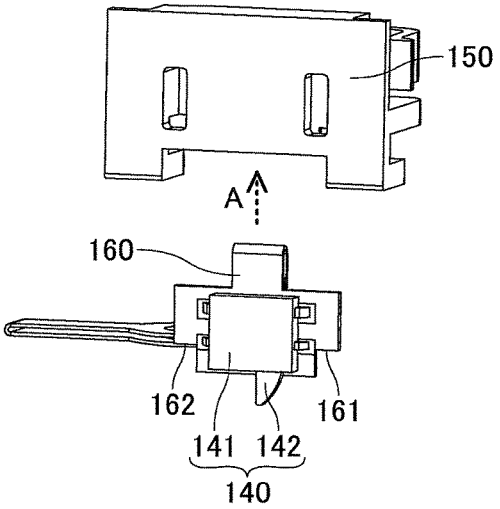
FIGS. 10A and 10B are axonometric views illustrating the detection switch and the switch holder.
Figure 10B:
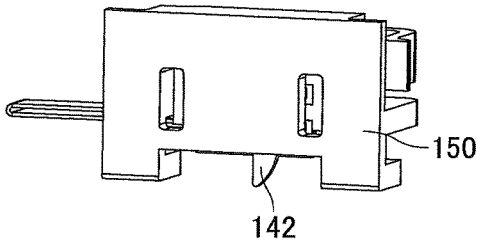
Figure 11A:
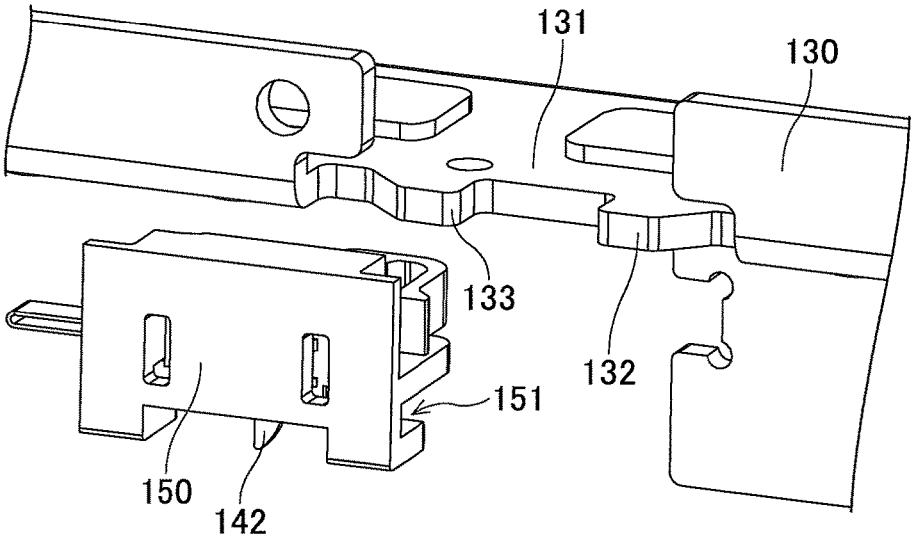
FIGS. 11A and 11B are illustrative drawings showing the mounting of the detection switch and the switch holder to a frame.
Figure 11B:
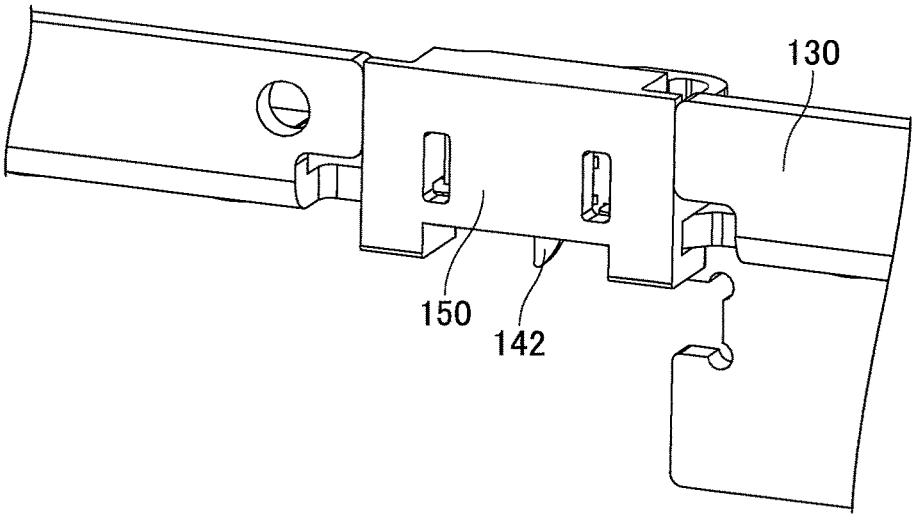

In the printer of the present embodiment, a detection switch 140 is placed in a switch holder 150 as illustrated in FIGS. 9A and 9B and FIGS. 10A and 10B to be mounted to a frame 130 of the printer mechanism unit 110 as illustrated in FIG. 8 and FIGS. 11A and 11B. The detection switch 140, which is a mechanical switch, includes a switch main unit 141 and an actuator 142. The detection switch 140 is connected to a flexible substrate 160 for transmitting electrical signals. FIG. 9A is an axonometric view of the detection switch 140. FIG. 9B is an axonometric view of the switch holder 150.

In the present embodiment, the detection switch 140 is inserted into the switch holder 150 from the direction indicated by a dotted-line arrow A as illustrated in FIG. 10A. With the detection switch 140 being placed in the switch holder 150, the actuator 142 projects to the outside of the switch holder 150 as illustrated in FIG. 10B.

As illustrated in FIG. 11A, a mounting part 131 of the frame 130, to which the detection switch 140 placed in the switch holder 150 is mounted, has two frame projections 132 and 133 that project toward the switch holder 150. The switch holder 150 has a holder support part 151 that has a rectangular-shaped recess which corresponds in shape to the frame projections 132 and 133. When the switch holder 150 is mounted to the frame 130 as illustrated in FIG. 11B, the frame projections 132 and 133 are engaged in the holder support part 151. With this engagement, the switch holder 150 is supported by the frame 130 such that the detection switch 140 is positioned in the on-off detection direction.

Figure 12A:
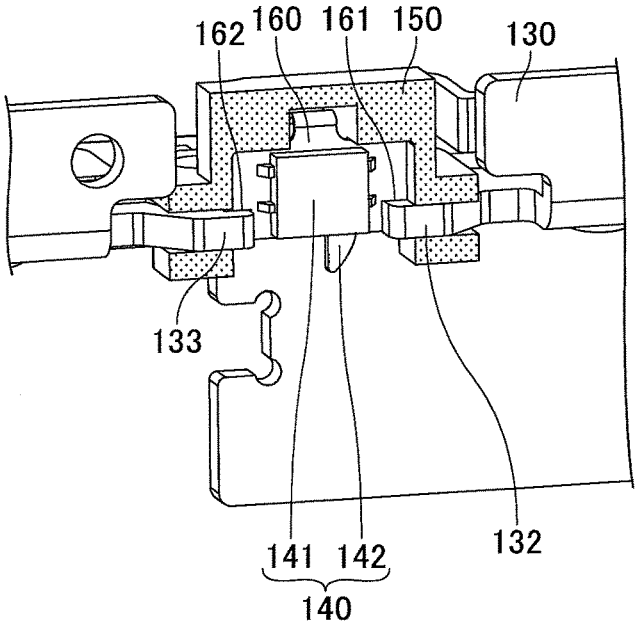
FIG. 12A is an axonometric view of the switch holder illustrating a cross-section of the switch holder mounted to the frame.
Figure 12B:
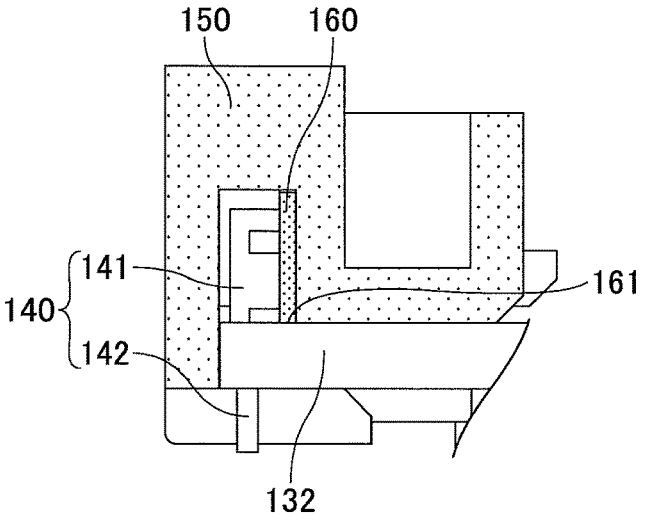
FIG. 12B is a cross-sectional view of the switch holder taken along a plane perpendicular to the longitudinal direction of the frame.

In the present embodiment, the mounting of the detection switch 140 is enabled by mounting the switch holder 150 to the frame 130. The detection switch 140 is suitably mounted to a desired position by use of the holder support part 151 and the frame projections 132 and 133. FIG. 12A is an axonometric view of the switch holder 150 illustrating a cross-section of the switch holder 150 mounted to the frame 130. FIG. 12B is a cross-sectional view of the switch holder 150 taken along a plane perpendicular to the longitudinal direction of the frame 130.

As illustrated in FIG. 10A and FIG. 12A, the flexible substrate 160 has two notches 161 and 162 at the bottom edge. With the switch holder 150 being mounted to the frame 130 as illustrated in FIG. 12A, the notches 161 and 162 are in contact with the frame projections 132 and 133, respectively, to face each other in the vertical direction as well as in the horizontal direction, so that the flexible substrate 160 is unmovable from its place relative to the frame 130.

<Internal Structure of Switch Holder>

Figure 13A:
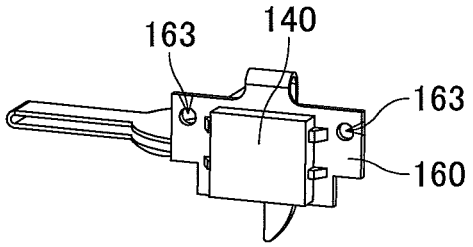
FIG. 13A is an axonometric view of the switch.
Figure 13B:
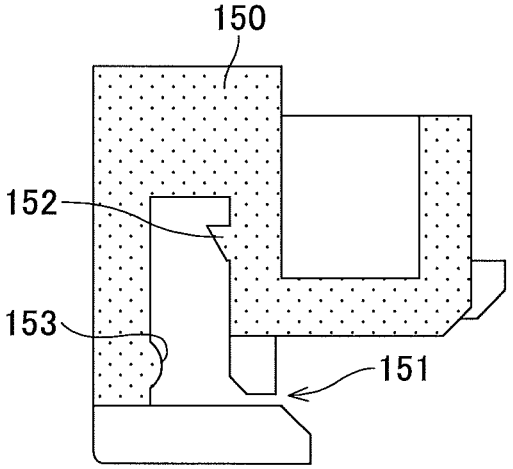
FIG. 13B is a cross-sectional view of the switch holder.
Figure 14A:
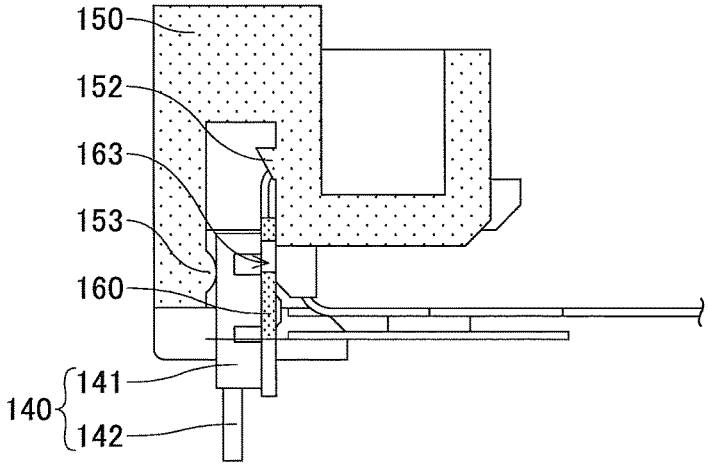
FIG. 14A is an illustrative view showing the detection switch inserted halfway into the switch holder.
Figure 14B:
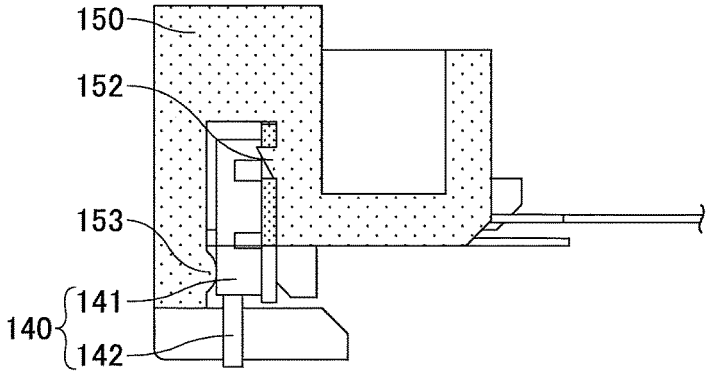
FIG. 14B is an illustrative view showing the detection switch mounted to the switch holder.
Figure 15:
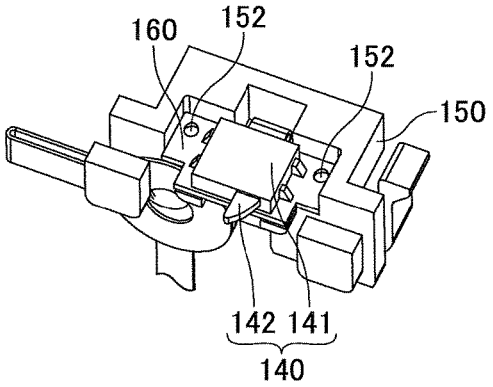
FIG. 15 is an axonometric view of the inside of the switch holder to which the detection switch connected to a flexible substrate is mounted.

In the present embodiment, the flexible substrate 160 connected to the detection switch 140 may have securing holes 163 as illustrated in FIG. 13A, and the switch holder 150 may have holder projections 152 at the position corresponding to the securing holes 163, respectively. FIG. 14A illustrates the detection switch 140 inserted halfway into the switch holder 150. FIG. 14B illustrates the detection switch 140 mounted to the switch holder 150. As illustrated in FIG. 14B, the detection switch 140 connected to the flexible substrate 160 is fully inserted into the switch holder 150 to cause the holder projections 152 to enter the securing holes 163 of the flexible substrate 160. With this arrangement, the detection switch 140 is fixedly mounted to the switch holder 150 via the flexible substrate 160 and accurately positioned in the on/off-detection direction of the detection switch 140 (i.e., the vertical direction in FIG. 14B) as well as in the longitudinal direction of the switch holder 150 (i.e., the direction normal to the sheet of FIG. 14B) perpendicular to the on/off-detection direction of the detection switch 140. FIG. 15 is an axonometric view of the inside of the switch holder 150 to which the detection switch 140 connected to the flexible substrate 160 is mounted.

Figure 16A:
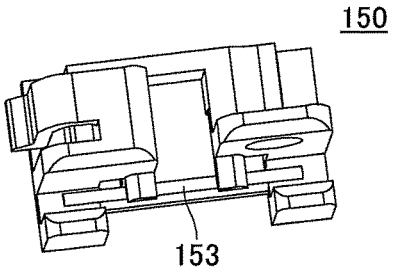
FIG. 16A is an axonometric view of the switch holder as viewed from bottom.
Figure 16B:
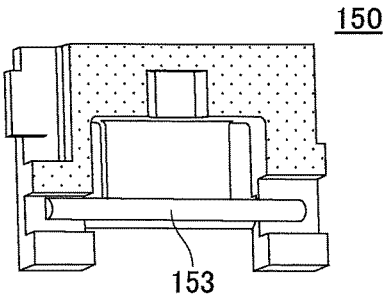
FIG. 16B is an axonometric view of the switch holder.

As illustrated in FIGS. 14A and 14B and the like, the internal face of the switch holder 150 opposite the face having the holder projections 152 has a lib 153 formed thereon. As illustrated in FIGS. 16A and 16B, the lib 153 projects from the internal face of the switch holder 150 with an arc-shaped cross-section or the like. With the detection switch 140 being mounted to the switch holder 150, the lib 153 is in line contact or point contact with the detection switch 140. FIG. 16A is an axonometric view of the switch holder 150 as viewed from bottom. FIG. 16B is an axonometric view of the switch holder 150. With the provision of the lib 153 on the internal face of the switch holder 150, the detection switch 140 is fastened between the lib 153 and the face having the holder projections 152 inside the switch holder 150 as illustrated in FIG. 14B. Accordingly, the detection switch 140 is fixed inside the switch holder 150 in the horizontal direction in FIG. 14B. The detection switch 140 has an internal component that slidably moves in response to the pressing of the actuator 142. Keeping the detection switch 140 under a strong surface pressure may have a harmful effect on the slidable component. Because of this, the contact between the lib 153 and the detection switch 140 is preferably a point contact or a line contact.

Further, the switch holder 150 is preferably made of an insulating material, which may specifically be a resin material having insulating property. With this arrangement, insulation is provided between the metal frame 130 and the detection switch 140 due to the insulating property of the switch holder 150 even when the case of the detection switch 140 is made of a material having electrical conductivity.

<External Structure of Switch Holder>

Figure 17A:
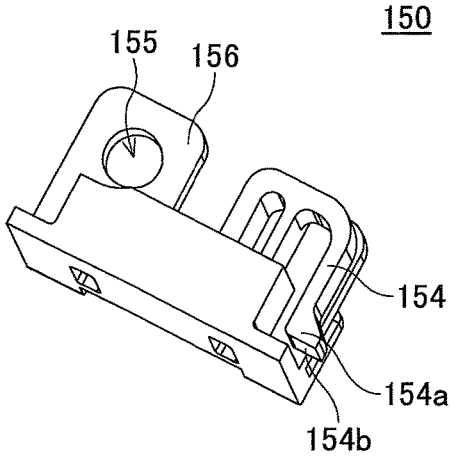
FIG. 17A is an axonometric view of the switch holder.
Figure 17B:
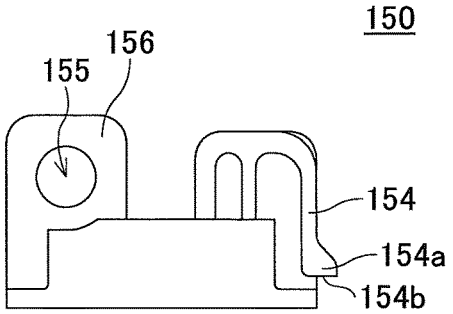
FIG. 17B is a top view of the switch holder.

The switch holder 150 may include a snap-fit part 154 as illustrated in FIGS. 17A and 17B, which is attached to the frame 130 through snap-in locking. One end of the snap-fit part 154 has a hook 154*a* having an end face 154*b*. FIG. 17A is an axonometric view of the switch holder 150. FIG. 17B is a top view of the switch holder 150.

Figure 18A:
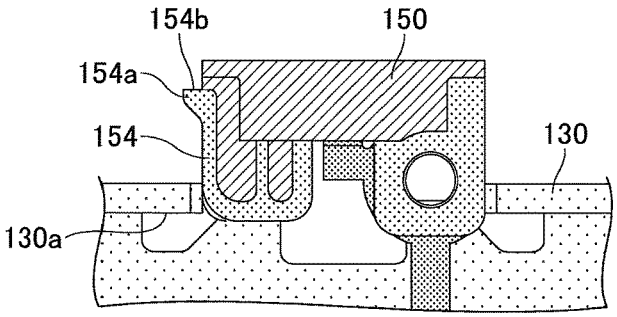
FIGS. 18A through 18C are axonometric views illustrating the mounting of the switch holder to the frame.
Figure 18B:
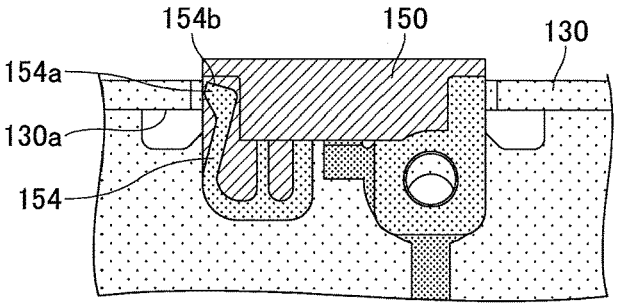
Figure 18C:
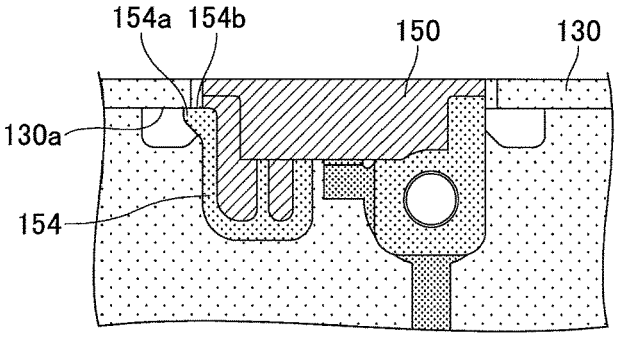

In order to mount the switch holder 150 to the frame 130, the switch holder 150 is brought in contact with the frame 130 from the opposite side to where the hook 154*a* of the snap-fit part 154 is situated as illustrated in FIG. 18A. The switch holder 150 is made of a resin material and thus elastic. As the switch holder 150 is pressed against the frame 130, the hook 154*a* coming in contact with the frame 130 is bent as illustrated in FIG. 18B. As the switch holder 150 is pressed further, the entirety of the snap-fit part 154 is brought into the inside of the frame 130, with the hook 154*a* returning to its original shape as illustrated in FIG. 18C. In this manner, the frame 130 is securely mounted to the switch holder 150. In this state, an inside face 130*a* of the frame 130 and the end face 154*b* of the snap-fit part 154 are in contact with each other, thereby preventing the switch holder 150 from disengaging from the frame 130.

Figure 19A:
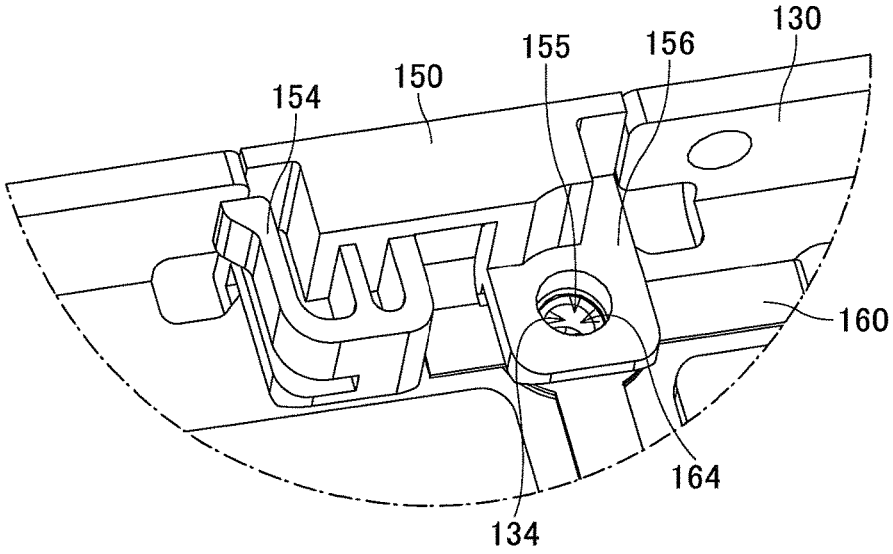
FIG. 19A is an axonometric view of the frame to which the switch holder is attached.
Figure 19B:
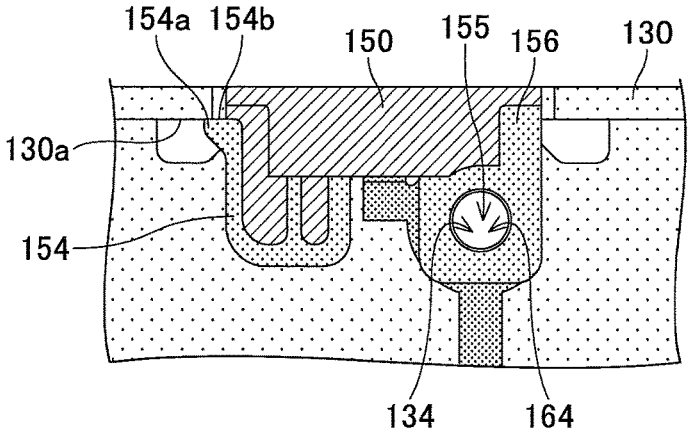
FIG. 19B is a top view of the frame to which the switch holder is attached.

The switch holder 150 may have a securing part 156 having a holder mounting hole 155 for screw mounting to the frame 130 as illustrated in FIGS. 17A and 17B. As illustrated in FIGS. 19A and 19B, the flexible substrate 160 connected to the detection switch 140 has a mounting hole 164 formed therein. The holder mounting hole 155 of the securing part 156 is formed at the same position as the mounting hole 164. This position matches the position of a frame mounting hole 134 formed in the frame 130 when the switch holder 150 is mounted to the frame 130. Namely, the holder mounting hole 155, the mounting hole 164, and the frame mounting hole 134 are aligned with each other when the switch holder 150 is mounted to the frame 130. FIG. 19A is an axonometric view of the frame 130 to which the switch holder 150 is attached. FIG. 19B is a top view of the frame 130 to which the switch holder 150 is attached. In the mounted state, the flexible substrate 160 is placed between the frame 130 and the securing part 156 around the position of the mounting hole 164 as illustrated in FIG. 19A.

Figure 20:
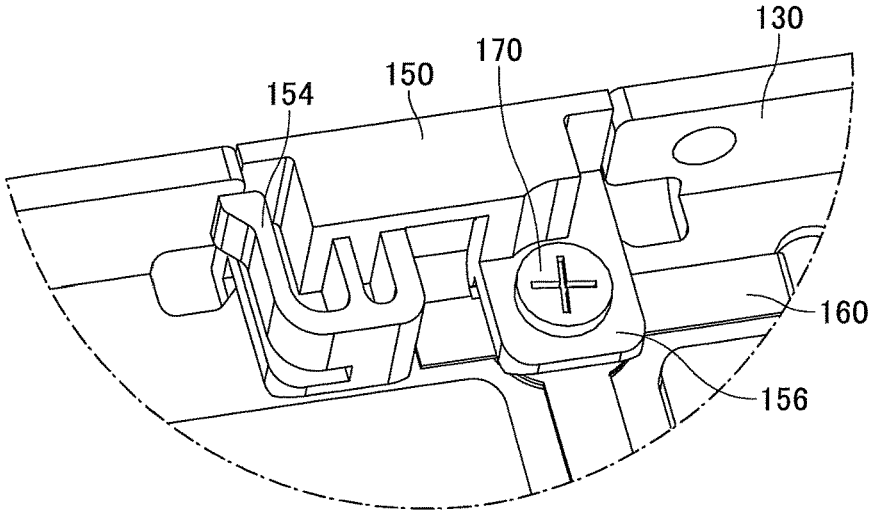
FIG. 20 is an illustrative drawing showing the securing of the switch holder on the frame.

With the frame mounting hole 134, the mounting hole 164, and the holder mounting hole 155 being aligned with each other, a screw 170 is used to fasten the frame 130, the flexible substrate 160, and the switch holder 150 with each other, thereby securing the switch holder 150 on the frame 130 as illustrated in FIG. 20. In this state, the flexible substrate 160 is fixedly placed between the frame 130 and the switch holder 150. In the present embodiment, the flexible substrate 160 is placed between the frame 130 and the securing part 156 that are threadably mounted to each other. With this arrangement, the flexible substrate 160 is not in direct contact with the screw 170, and is not directly under the force of screw mounting. The flexible substrate 160 is thus free from displacement during the screw mounting operation, and is not prone to break despite the thinness of the flexible substrate 160.

Figure 21:
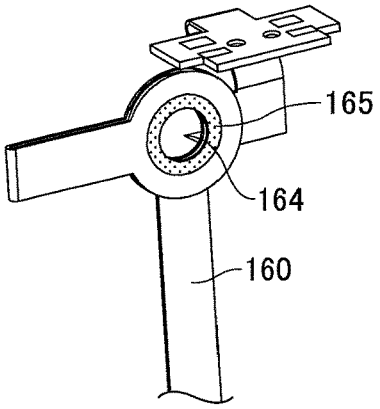
FIG. 21 is an illustrative drawing showing the flexible substrate.
Figure 22:
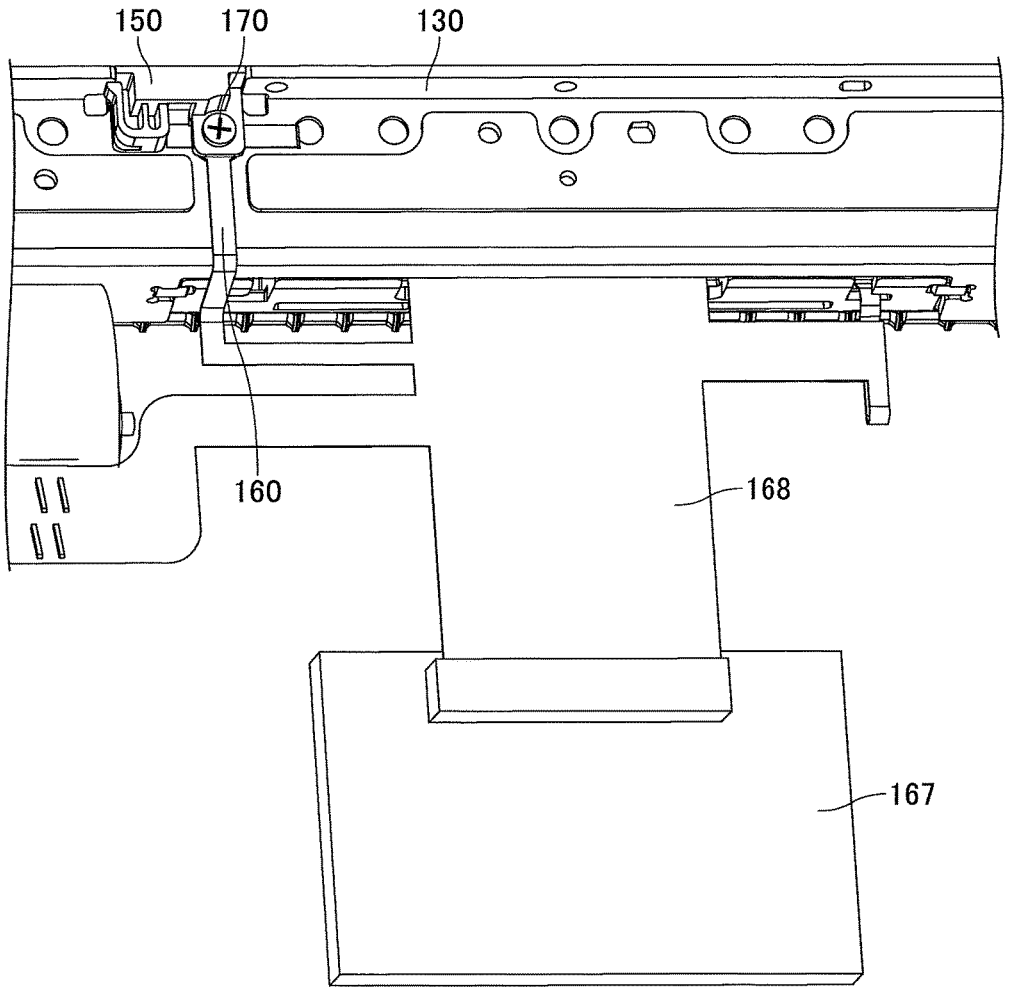
FIG. 22 is an illustrative drawing showing a flexible substrate.

In the present embodiment, as illustrated in FIG. 21, a ground pattern 165 is exposed around the mounting hole 164 on the same surface of the flexible substrate 160 that comes in contact with the frame 130. With this arrangement, the screw mounting causes the ground pattern 165 to be in contact with the frame 130 as can be understood from FIG. 20. The frame 130 made of a metal material is set to a ground potential. Bringing the ground pattern 165 in contact with the frame 130 causes the ground pattern 165 to be set to the ground potential. In the printer of the present embodiment, a control substrate 167 of the printer and the thermal head are coupled through a flexible substrate 168 as illustrated in FIG. 22. The flexible substrate 160 is a branch part of the flexible substrate 168.

Figure 23:
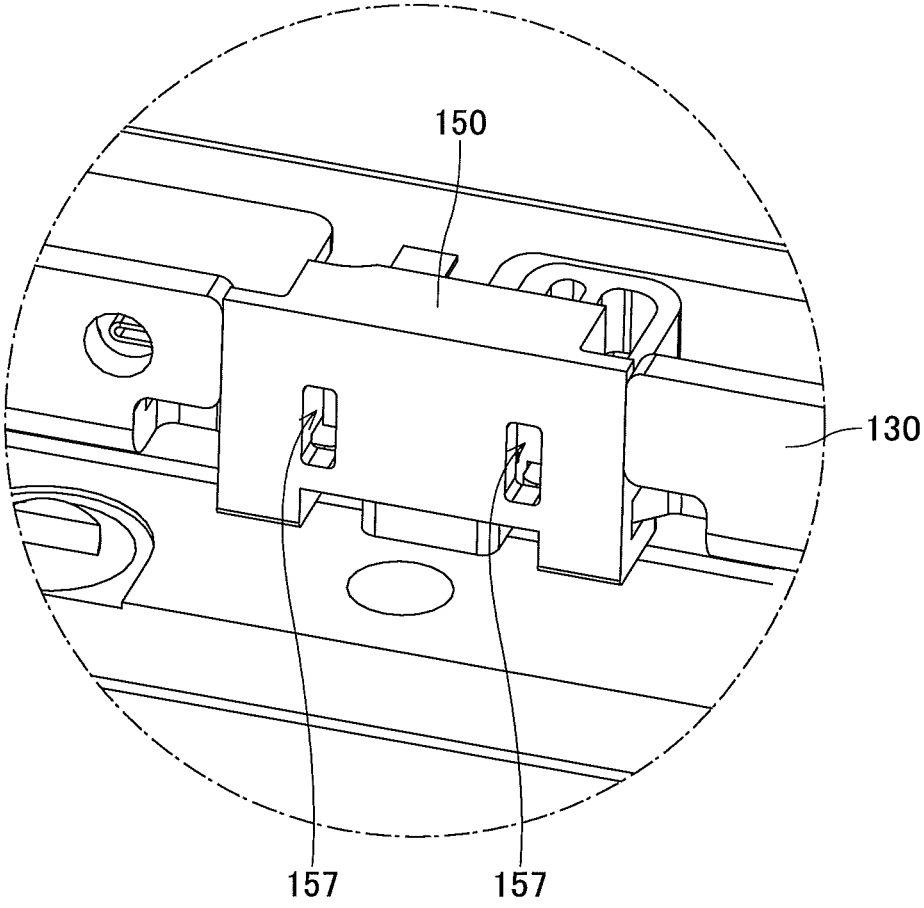
FIG. 23 is an illustrative drawing showing the switch holder on the frame.

As illustrated in FIG. 23, the switch holder 150 may have visual-inspection holes 157 that allow visual inspection to be made as to whether the detection switch 140 is mounted at a correct position. The switch holder 150 having the detection switch 140 attached thereto may alternatively be mounted from the back side of the printer as was described in connection with FIG. 1 to FIGS. 3A through 3C, or may alternatively be mounted to the side face of the frame as was described in connection with FIGS. 6A and 6B.

<Connection Between Printer Mechanism Unit and Platen Unit>

In the following, a description will be given of the connection between the printer mechanism unit 110 and the platen unit 120 in the printer of the present embodiment.

Figure 24A:
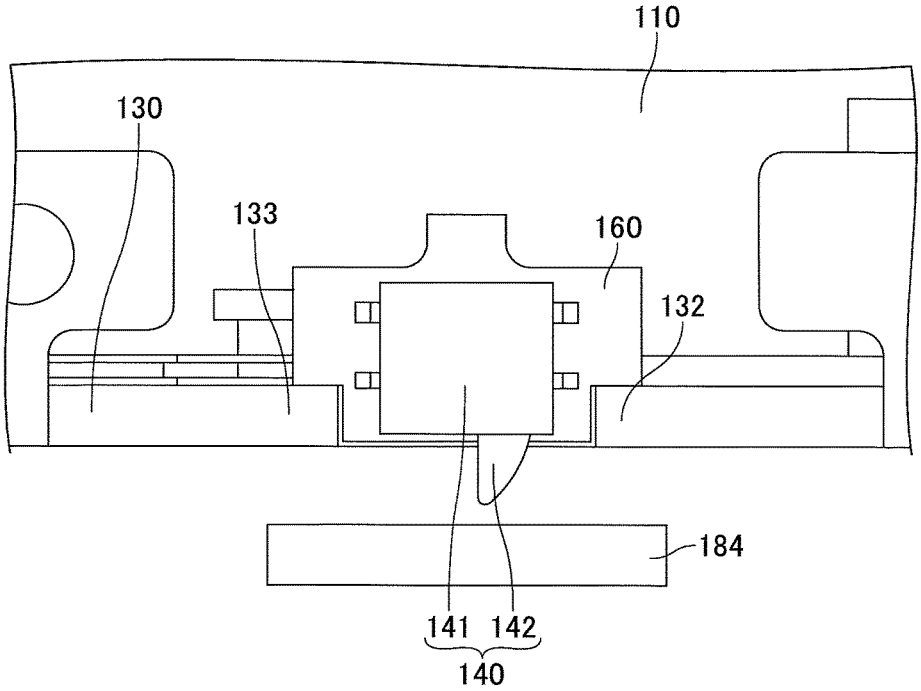
FIG. 24A is a transparent view of the detection switch and surrounding parts before a printer mechanism unit and a platen unit are connected to each other.
Figure 24B:
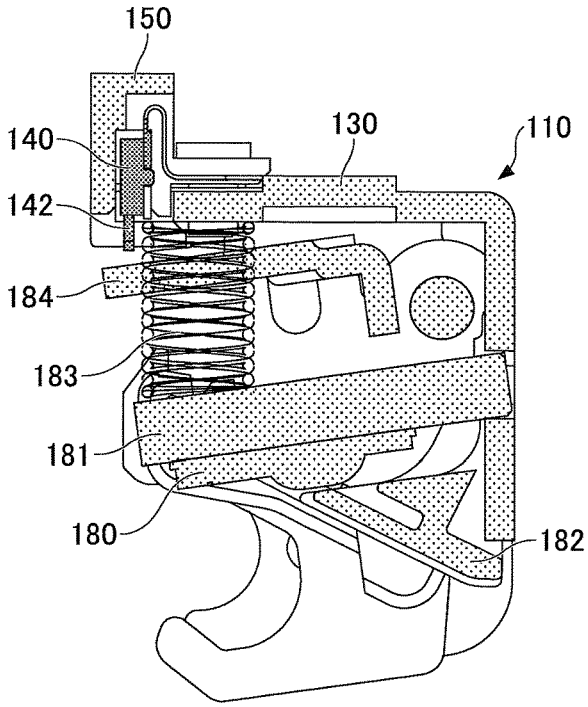
FIG. 24B is a cross-sectional view of the detection switch and the surrounding parts before the printer mechanism unit and the platen unit are connected to each other.
Figure 25A:
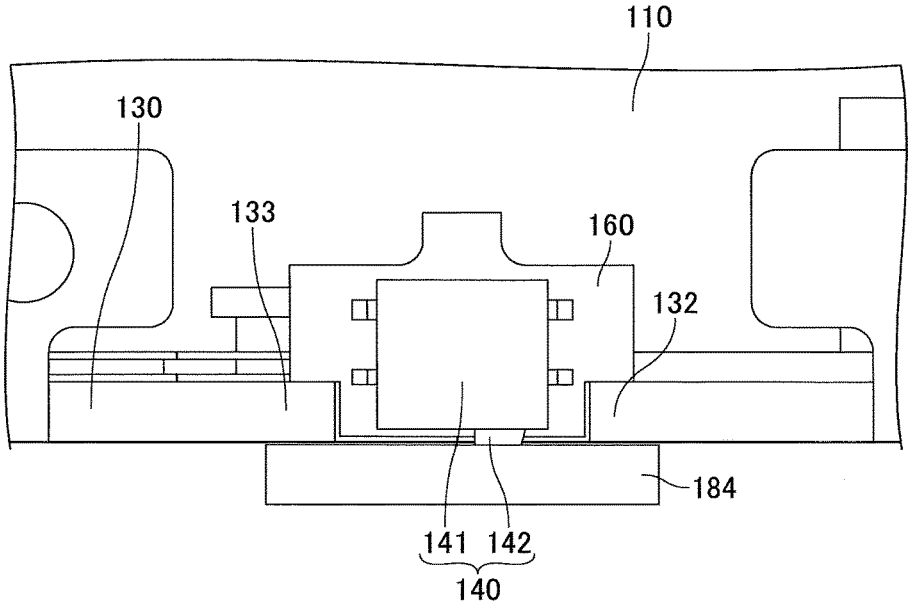
FIG. 25A is a transparent view of the detection switch and the surrounding parts when the printer mechanism unit and the platen unit are connected to each other.
Figure 25B:
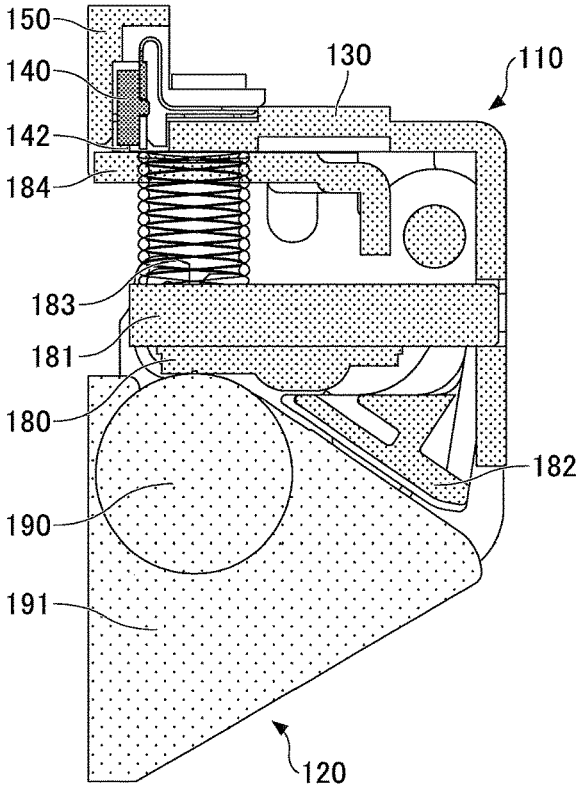
FIG. 25B is a cross-sectional view of the detection switch and the surrounding parts when the printer mechanism unit and the platen unit are connected to each other.

As illustrated in FIGS. 24A and 24B as well as in FIGS. 25A and 25B, the printer mechanism unit 110 includes a thermal head 180, a heat sink 181 situated on the back face of the thermal head 180, and a recording sheet guide 182 disposed to face the front face of the thermal head 180. A coil spring 183 is disposed between the frame 130 and the heat sink 181. The printer mechanism unit 110 also includes a pressing member 184 that presses the actuator 142 upon connecting the printer mechanism unit 110 to the platen unit 120. The platen unit 120 includes a platen roller 190 and a bracket 191. FIG. 24A is a transparent view of the detection switch 140 and the surrounding parts before the printer mechanism unit 110 and the platen unit 120 are connected to each other. FIG. 24B is a cross-sectional view of the detection switch 140 and the surrounding parts before the printer mechanism unit 110 and the platen unit 120 are connected to each other. FIG. 25A is a transparent view of the detection switch 140 and the surrounding parts when the printer mechanism unit 110 and the platen unit 120 are connected to each other. FIG. 25B is a cross-sectional view of the detection switch 140 and the surrounding parts when the printer mechanism unit 110 and the platen unit 120 are connected to each other.

As the printer mechanism unit 110 and the platen unit 120 illustrated in FIGS. 24A and 24B are connected to each other, the platen roller 190 presses the thermal head 180 to cause the thermal head 180 to move toward the back side as illustrated in FIG. 25B. In conjunction with this movement of the thermal head 180, the heat sink 181, the recording sheet guide 182, and the pressing member 184 move toward the direction of the detection switch 140, resulting in the pressing member 184 pressing the actuator 142 to turn on the detection switch 140. As a result, the connecting of the platen unit 120 to the printer mechanism unit 110 is detected. In this state, a recording sheet is placed between the thermal head 180 and the platen roller 190, thereby enabling the thermal head 180 to print on the recording sheet while the recording sheet is advanced by the platen roller 190.

In the present embodiment, the frame 130 has the frame projections 132 and 133. Because of this, the pressing member 184 is unable to enter the space between the frame projections 132 and 133 where the switch main unit 141 is situated, which serves to protect the detection switch 140.

In the absence of the frame projections 132 and 133 of the frame 130, the pressing member 184 could have a risk of excessively pressing the actuator 142 to break the detection switch 140. In the present embodiment, the provision of the frame projections 132 and 133 on the frame 130 serves to prevent the pressing member 184 from excessively pressing the actuator 142.

According to at least one embodiment, a printer is provided that has a detection switch installed at a desired position for detecting whether the printer mechanism unit is connected to the platen unit.

Further, although a description has been given with respect to one or more embodiments of the present invention, the contents of such a description do not limit the scope of the invention.

The present application is based on and claims the benefit of priority of Japanese priority application No. 2016-103096 filed on May 24, 2016, with the Japanese Patent Office, the entire contents of which are hereby incorporated by reference.

What is claimed is:

1. A printer comprising:

a printer mechanism unit including a frame and a print head;

a platen unit including a platen roller;

a detection switch configured to detect connecting of the platen unit to the printer mechanism unit; and a switch holder having the detection switch attached thereto and covering part of the detection switch, wherein the switch holder is mounted to one of the frame and the platen unit, wherein the frame has one or more frame projections, and the switch holder includes a holder support part having one or more recesses that correspond in shape to the one or more frame projections, and wherein the one or more frame projections are inserted into the one or more recesses, respectively, of the holder support part, thereby causing the switch holder to be mounted to the frame.

2. The printer as claimed in claim 1, wherein the detection switch includes a switch main body and an actuator, and the actuator is pressed by a pressing member upon connecting the platen unit to the printer mechanism unit, and wherein a gap exists between the switch main body and the pressing member while the pressing member is being in contact with the one or more frame projections of the frame.

3. A printer comprising:

a printer mechanism unit including a frame and a print head;

a platen unit including a platen roller;

a detection switch configured to detect connecting of the platen unit to the printer mechanism unit; and a switch holder having the detection switch attached thereto and covering part of the detection switch, wherein the switch holder is mounted to one of the frame and the platen unit, wherein the switch holder has such an opening that the detection switch is inserted through the opening into the switch holder to be placed and fastened therein, wherein the detection switch is connected to a flexible substrate, and the switch holder has one or more holder projections, and wherein the flexible substrate has one or more securing holes corresponding in position to the one or more holder projections, and the one or more holder projections enter the one or more securing holes, respectively, of the flexible substrate when the detection switch is attached to the switch holder.

4. A printer comprising:

a printer mechanism unit including a frame and a print head;

a platen unit including a platen roller;

a detection switch configured to detect connecting of the platen unit to the printer mechanism unit; and a switch holder having the detection switch attached thereto and covering part of the detection switch, wherein the switch holder is mounted to one of the frame and the platen unit, wherein the switch holder has such an opening that the detection switch is inserted through the opening into the switch holder to be placed and fastened therein, wherein the switch holder has a securing part through which a holder mounting hole is formed for fastening to the frame, and the frame has a frame mounting hole corresponding in position to the holder mounting hole, wherein the detection switch is connected to a flexible substrate, and wherein the flexible substrate has a mounting hole corresponding in position to the holder mounting hole and the frame mounting hole, and is fastened between the frame and the securing part through a screw.

5. The printer as claimed in claim 4, wherein a wiring pattern is disposed around the mounting hole on the same surface of the flexible substrate that is in contact with the frame, and the frame is made of a metal material, and wherein the wiring pattern comes in contact with the frame upon fastening the flexible substrate through the screw.

6. A printer comprising:

a printer mechanism unit including a frame and a print head;

a platen unit including a platen roller;

a detection switch configured to detect connecting of the platen unit to the printer mechanism unit; and a switch holder having the detection switch attached thereto and covering part of the detection switch, wherein the switch holder is mounted to one of the frame and the platen unit, wherein the switch holder is made of an elastic material, and includes a snap-fit part to be engaged with the frame and a hook formed as part of the snap-fit part, and wherein a tip of the hook comes in contact with the frame upon mounting the switch holder to the frame.

7. A printer comprising:

a printer mechanism unit including a frame and a print head;

a platen unit including a platen roller;

a detection switch configured to detect connecting of the platen unit to the printer mechanism unit; and a switch holder having the detection switch attached thereto and covering part of the detection switch, wherein the switch holder is mounted to one of the frame and the platen unit, wherein a first internal face of the switch holder has a rib formed thereon, the detection switch is fastened inside the switch holder between the rib on the first internal face and a second internal face of the switch holder opposite the first internal face.

* * * * *